US005682312A

United States Patent [19]

Rocke

[11] Patent Number: 5,682,312

[45] Date of Patent: Oct. 28, 1997

[54] SELF-ADAPTING EXCAVATION CONTROL SYSTEM AND METHOD

[75] Inventor: David J. Rocke, Eureka, Ill.

[73] Assignee: Caterpillar Inc., Peoria, Ill.

[21] Appl. No.: 618,079

[22] Filed: Mar. 18, 1996

Related U.S. Application Data

[63] Continuation of Ser. No. 217,033, Mar. 23, 1994, abandoned.

[51] Int. Cl.[6] ..... G06F 19/00

[52] U.S. Cl. ..... 364/424.07; 37/414

[58] Field of Search ..... 364/167.01, 181, 364/424.07; 37/414, 416; 172/4.5; 414/699; 395/904

[56] References Cited

U.S. PATENT DOCUMENTS

| | | | |
|---|---|---|---|
| 3,583,585 | 6/1971 | Joyce | 214/138 |
| 3,636,325 | 1/1972 | Chytil | 364/424.07 X |
| 4,332,517 | 6/1982 | Igarashi et al. | 414/699 |
| 4,377,043 | 3/1983 | Inui et al. | 37/414 |
| 4,742,468 | 5/1988 | Ohashi et al. | 364/424.07 |
| 4,910,673 | 3/1990 | Narisawa et al. | 364/424.07 |
| 5,002,454 | 3/1991 | Hadank et al. | 414/695.5 |
| 5,065,326 | 11/1991 | Sahm | 364/424.07 |
| 5,088,020 | 2/1992 | Nishida et al. | 364/424.07 X |
| 5,116,186 | 5/1992 | Hanamoto et al. | 414/694 |
| 5,128,599 | 7/1992 | Nikolaus et al. | 318/685 |
| 5,160,239 | 11/1992 | Allen et al. | 414/699 |
| 5,170,342 | 12/1992 | Nakamura et al. | 364/167.01 |
| 5,178,510 | 1/1993 | Hanamoto et al. | 414/694 |
| 5,186,579 | 2/1993 | Hanamoto et al. | 395/904 |
| 5,218,895 | 6/1993 | Lukich et al. | 91/361 |
| 5,359,517 | 10/1994 | Moriya et al. | 364/424.07 |
| 5,361,211 | 11/1994 | Lee et al. | 364/424.07 |
| 5,383,390 | 1/1995 | Lukich | 91/361 |
| 5,446,980 | 9/1995 | Rocke | 364/424.07 X |
| 5,474,557 | 12/1995 | Moriya et al. | 364/424.07 |

OTHER PUBLICATIONS

"Design of Automated Loading Buckets", P. A. Mikhirev, pp. 292–298, Institute of Mining, Siberian Branch of the Academy of Sciences of the USSR, Nevosibirsk. Translated from Fiziko–Tekhnicheskie Problemy Razrabotki Poleznykh Iskopaemykh, No. 4, pp. 79–86, Jul.–Aug., 1986. Original Article Submitted Sep. 28, 1984, Plenum Publishing Corporation, 1987.

"Method of Dipper Filling Control for a Loading–Transporting Machine Excavating Ore in Hazardous Locations", V. L. Konyukh et al., pp. 132–138, Institute of Coal, Academy of Sciences of the USSR, Siberian Branch, Kemorovo. Translated from Fiziko–Tekhnicheskie Problemy Razrabotki Poleznykh Iskopaemykh, No. 2, pp. 67–73, Mar.–Apr., 1988.

"Automated Excavator Study", James G. Cruz, A Special Research Problem Presented to the Faculty of the Construction Engineering and Management Program, Purdue University, Jul. 23, 1990.

"Just Weigh It and See", Mike Woof, p. 27, Construction News, Sep. 9, 1993.

(List continued on next page.)

*Primary Examiner*—Collin W. Park
*Attorney, Agent, or Firm*—Steven G. Kibby; David M. Masterson

[57] ABSTRACT

A control system for automatically controlling a work implement of an excavating machine through a machine work cycle in disclosed. The work implement including a boom, stick and bucket, each being controllably actuated by at least one respective hydraulic cylinder. A plurality of command signal magnitudes associated with at least one hydraulic cylinder are stored. The command signal magnitudes are represented by a plurality of control curves, where each control curve is responsive to a material condition setting that is representative of a predetermined condition of the excavating material. A microprocessor selects one of the plurality of control curves and responsively produces a command signal having a magnitude dictated by the selected control curve. A electrohydraulic system receives the command signal and controllably actuates predetermined ones of the hydraulic cylinders to perform the work cycle.

19 Claims, 14 Drawing Sheets

OTHER PUBLICATIONS

"An Intelligent Task Control System for Dynamic Mining Environments", Paul J.A. Lever et al., pp. 1–6, Presented at 1994 SME Annual Meeting, Albuquerque, New Mexico, Feb. 14–17, 1994.

"Cognitive Force Control of Excavators", P.K. Vaha et al., pp. 159–166. The Manuscript for this Paper was Submitted for Review and Possible Publication on Oct. 9, 1990. This Paper is Part of the Journal of Aerospace Engineering, vol. 6, No. 2, Apr. 1993.

"A Laboratory Study of Force–Cognitive Excavation", D.M. Bullock et al, Jun. 6–8, 1989, Proceedings of the Sixth International Symposium on Automation and Robotics in Construction.

"A Microcomputer–Based Agricultural Digger Control System", E.R.I. Deane et al., Dec. 20, 1988, Computers and Electronics in Agriculture (1989), Elsevier Science Publishers.

"Artificial Intelligence in the Control and Operation of Construction Plant–The Autonomous Robot Excavator", D.A. Bradley et al., Automation in Construction 2 (1993), Elsevier Science Publishers B.V.

"Control and Operational Strategies for Automatic Excavation" D.A. Bradley et al., Proceedings of the Sixth International Symposium on Automation and Robotics in Construction, Jun. 6–8, 1989.

"Development of Unmanned Wheel Loader System–Application to Asphalt Mixing Plant", H. Oshima et al., Published by Komatsu, Nov. 1992.

"Motion and Path Control for Robotic Excavation", L.E. Bernold, Sep. 1990, Submitted to the ASCE Journal of Aerospace Engrg.

| PAYLOAD/WORK | MATERIAL CONDITION SETTING |
|---|---|
| 292 - ∞ | SETTING #1 |
| 269 - 292 | SETTING #2 |
| 246 - 269 | SETTING #3 |
| 224 - 246 | SETTING #4 |
| 201 - 224 | SETTING #5 |
| 178 - 201 | SETTING #6 |
| 156 - 178 | SETTING #7 |
| 134 - 156 | SETTING #8 |
| 134 - 0 | SETTING #9 |

SELF-ADAPTING EXCAVATION CONTROL SYSTEM AND METHOD

This is a file wrapper continuation of application Ser. No. 08/217,033, filed Mar. 23, 1994, now abandoned.

TECHNICAL FIELD

This invention relates generally to the field of excavation and, more particularly, to a self-adapting control system and method that automates the excavation work cycle of an excavating machine.

BACKGROUND ART

Work machines such as excavators, backhoes, front shovels, and the like are used for excavation work. These excavating machines have work implements which consist of boom, stick and bucket linkages. The boom is pivotally attached to the excavating machine at one end, and to its other end is pivotally attached a stick. The bucket is pivotally attached to the free end of the stick. Each work implement linkage is controllably actuated by at least one hydraulic cylinder for movement in a vertical plane. An operator typically manipulates the work implement to perform a sequence of distinct functions which constitute a complete excavation work cycle.

In a typical work cycle, the operator first positions the work implement at a dig location, and lowers the work implement downward until the bucket penetrates the soil. Then the operator executes a digging stroke which brings the bucket toward the excavating machine. The operator subsequently curls the bucket to capture the soil. To dump the captured load the operator raises the work implement, swings it transversely to a specified dump location, and releases the soil by extending the stick and uncurling the bucket. The work implement is then returned to the trench location to begin the work cycle again. In the following discussion, the above operations are referred to respectively as boom-down-into-ground, dig-stroke, capture-load, swing-to-dump, dump-load, and return-to-trench.

The earthmoving industry has an increasing desire to automate the work cycle of an excavating machine for several reasons. Unlike a human operator, an automated excavating machine remains consistently productive regardless of environmental conditions and prolonged work hours. The automated excavating machine is ideal for applications where conditions are dangerous, unsuitable or undesirable for humans. An automated machine also enables more accurate excavation making up for the lack of operator skill.

The present invention is directed to overcoming one or more of the problems as set forth above.

DISCLOSURE OF THE INVENTION

In one aspect of the present invention, a control system for automatically controlling a work implement of an excavating machine through a machine work cycle is disclosed. The work implement including a boom, stick and bucket, each being controllably actuated by at least one respective hydraulic cylinder. A plurality of command signal magnitudes associated with at least one hydraulic cylinder are stored. The command signal magnitudes are represented by a plurality of control curves, where each control curve is responsive to a material condition setting that is representative of a predetermined condition of the excavating material. A microprocessor selects one of the plurality of control curves and responsively produces a command signal having a magnitude dictated by the selected control curve. A electrohydraulic system receives the command signal and controllably actuates predetermined ones of the hydraulic cylinders to perform the work cycle.

BRIEF DESCRIPTION OF THE DRAWINGS

For a better understanding of the present invention, reference may be made to the accompanying drawings in which.

BEST MODE FOR CARRYING OUT THE INVENTION

Figure 1A:
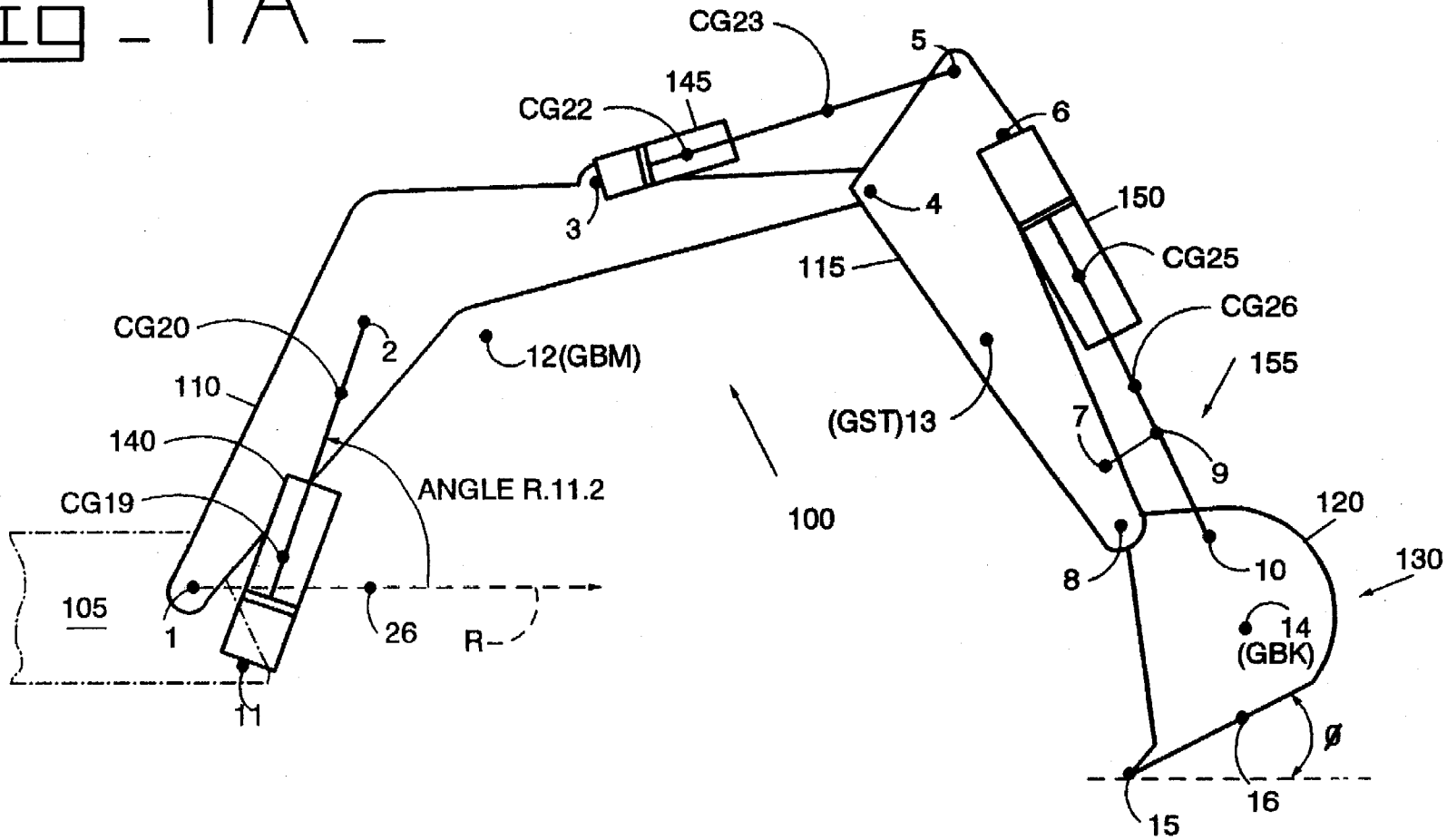
FIGS. 1A,1B are a diagrammatic views of a work implement of an excavating machine.
Figure 1B:
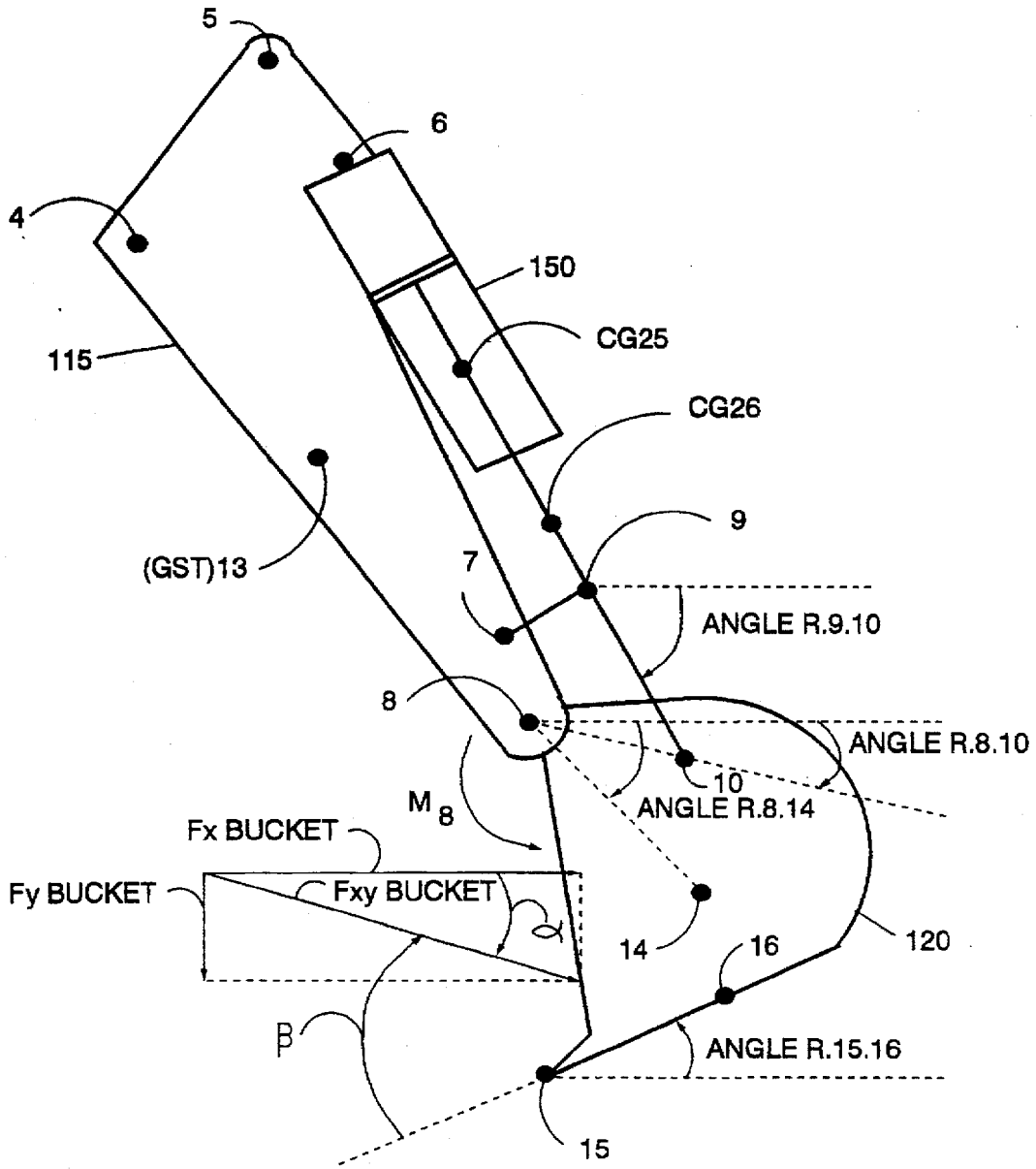

With reference to the drawings, FIG. 1 shows a planar view of a work implement 100 of an excavating machine, which performs digging or loading functions similar to that of an excavator, backhoe loader, and front shovel.

The excavating machine may include an excavator, power shovel, wheel loader or the like. The work implement 100 may include a boom 110 stick 115, and bucket 120. The boom 110, is pivotally mounted on the excavating machine 105 by boom pivot pin 1. The center of gravity of the boom (GBM) is represented by point 12. The stick 115 is pivotally connected to the free end of the boom 110 at stick pivot pin 4. The center of gravity of the stick (GST) is represented by point 13. The bucket 120 is pivotally attached to the stick 115 at bucket pivot pin 8. The bucket 120 includes a rounded portion 130, a floor designated by point 16, and a tip designated by point 15. The center of gravity of the bucket (GBK) is represented by point 14.

A horizontal reference axis, R, is defined having an origin at pin 1 extending through point 26. The axis, R, is used to measure the relative angular relationship between the work vehicle 105 and the various pins and points of the work implement 100.

The boom 110, stick 115 and bucket 120 are independently and controllably actuated by linearly extendable hydraulic cylinders. The boom 110 is actuated by at least one boom hydraulic cylinder 140 for upward and downward movements of the stick 115. The boom hydraulic cylinder 140 is connected between the work machine 105 and the boom 110 at pins 11 and 2. The center of gravities of the boom cylinder and cylinder rod are represented by points CG19,CG20, respectively. The stick 115 is actuated by at least one stick hydraulic cylinder 145 for longitudinal horizontal movements of the bucket 120. The stick hydraulic cylinder 145 is connected between the boom 110 and the stick 115 at pins 3 and 5. The center of gravities of the stick cylinder and cylinder rod are represented by points CG22, CG23, respectively. The bucket 120 is actuated by a bucket hydraulic cylinder 150 and has a radial range of motion about the bucket pivot pin 8. The bucket hydraulic cylinder 150 is connected to the stick 115 at pin 6 and to a linkage 155 at pin 9. The linkage 155 is connected to the stick 115 and the bucket 120 at pins 7 and 10, respectively. The center of gravities of the bucket cylinder and cylinder rod are represented by points CG25,CG26, respectively. For the purpose of illustration, only one boom, stick, and bucket hydraulic cylinder 140,145,150 is shown in FIG. 1.

To ensure an understanding of the operation of the work implement 100 and hydraulic cylinders 140,145,150 the following relationship is observed. The boom 110 is raised by extending the boom cylinder 140 and lowered by retracting the same cylinder 140. Retracting the stick hydraulic cylinders 145 moves the stick 115 away from the excavating machine 105, and extending the stick hydraulic cylinders 145 moves the stick 115 toward the machine 105. Finally, the bucket 120 is rotated away from the excavating machine 105 when the bucket hydraulic cylinder 150 is retracted, and rotated toward the machine 105 when the same cylinder 120 is extended.

Figure 2:
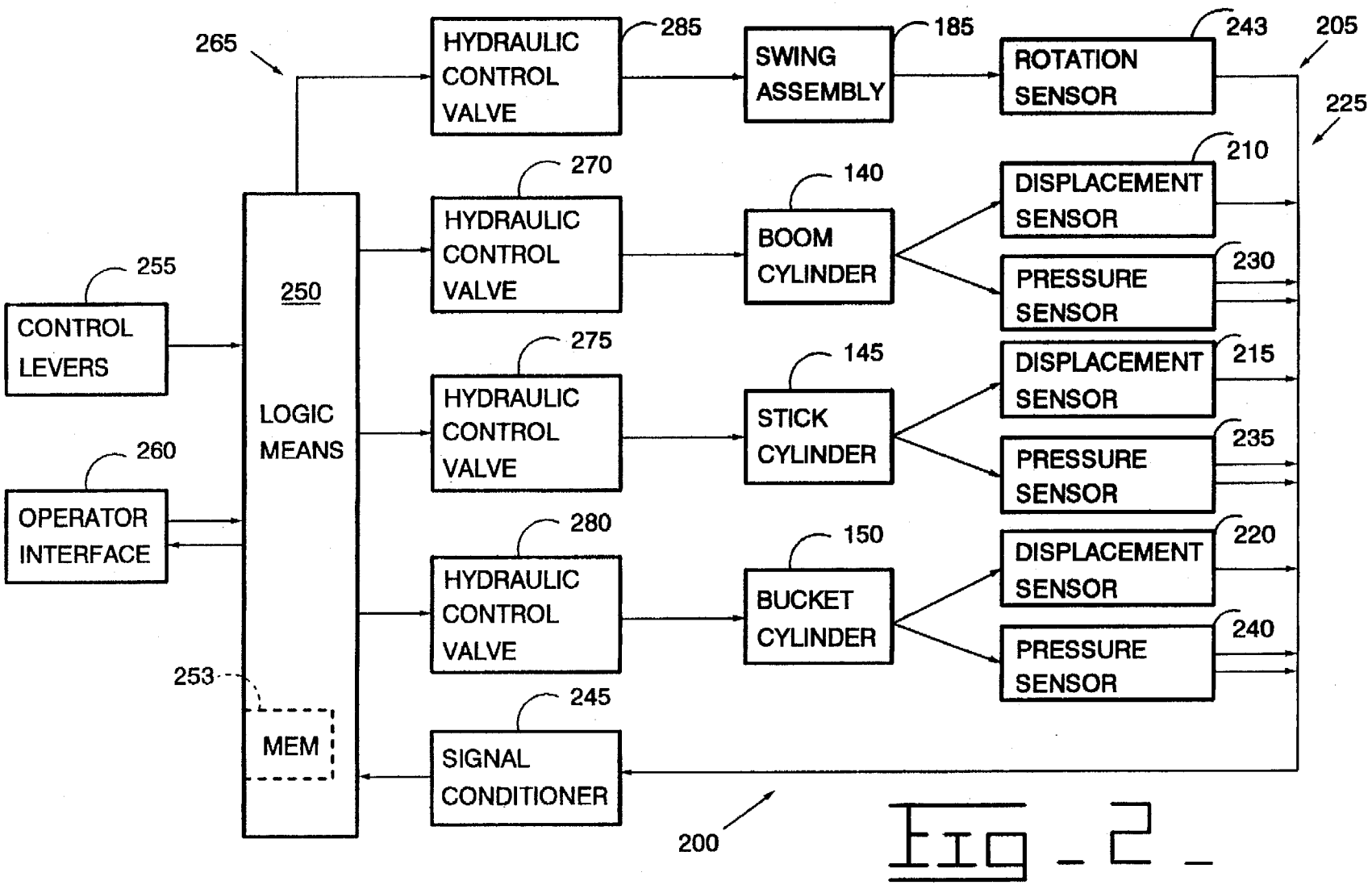
FIG. 2 is a hardware block diagram of a control system of the excavating machine.

Referring now to FIG. 2, a block diagram of an electro-hydraulic system 200 associated with the present invention is shown. A means 205 produces position signals in response to the position of the work implement 100. The means 205 includes displacement sensors 210,215,220 that sense the amount of cylinder extension in the boom, stick and bucket hydraulic cylinders 140,145,150 respectively. A radio frequency based sensor described in U.S. Pat. No. 4,737,705 issued to Bitar et al. on Apr. 12, 1988 may be used.

It is apparent that the work implement 100 position is also derivable from the work implement joint angle measurements. An alternative device for producing a work implement position signal includes rotational angle sensors such as rotatory potentiometers, for example, which measure the angles between the boom 110, stick 115 and bucket 120. The work implement position may be computed from either the hydraulic cylinder extension measurements or the joint angle measurement by trigonometric methods. Such techniques for determining bucket position are well known in the art and may be found in, for example, U.S. Pat. No. 3,997,071 issued to Teach on Dec. 14, 1976 and U.S. Pat. No. 4,377,043 issued to Inui et al. on Mar. 22, 1983.

A means 225 produces pressure signals in response to the force exerted on the work implement 100. The means 225 includes pressure sensors 230,235,240 which measure the hydraulic pressures in the boom, stick, and bucket hydraulic cylinders 140,145,150 respectively. The pressure sensors 230,235,240 each produce signals responsive to the pressures of the respective hydraulic cylinders 140,145,150. For example, cylinder pressure sensors 230,235,240 sense boom, stick and bucket hydraulic cylinder head and rod end pressures, respectively. A suitable pressure sensor is provided by Precise Sensors, Inc. of Monrovia, Calif. in their Series 555 Pressure Transducer, for example.

A swing angle sensor 243, such as a rotary potentiometer, located at the work implement pivot point 180, produces an angle measurement corresponding to the amount of work implement rotation about the swing axis, Y, relative to the dig location.

The position and pressure signals are delivered to a signal conditioner 245. The signal conditioner 245 provides conventional signal excitation and filtering. A Vishay Signal Conditioning Amplifier 2300 System manufactured by Measurements Group, Inc. of Raleigh, N.C. may be used for such purposes, for example. The conditioned position and pressure signals are delivered to a logic means 250. The logic means 250 is a microprocessor based system which utilizes arithmetic units to control process according to software programs. Typically, the programs are stored in read-only memory, random-access memory or the like. The programs are discussed in relation to various flowcharts.

The logic means 250 includes inputs from two other sources: multiple joystick control levers 255 and an operator interface 260. The control lever 255 provides for manual control of the work implement 100. The output of the control lever 255 determines the work implement 100 movement direction and velocity.

A machine operator may enter excavation specifications such as excavation depth and floor slope through an operator interface 260 device. The operator interface 260 may also display information relating to the excavating machine payload. The interface 260 device may include a liquid crystal display screen with an alphanumeric key pad. A touch sensitive screen implementation is also suitable. Further, the operator interface 260 may also include a plurality of dials and/or switches for the operator to make various excavating condition settings.

The logic means 250 receives the position signals and responsively determines the velocities of the boom 110, stick 115, and bucket 120 using well known differentiation techniques. It will be apparent to those skilled in the art that separate velocity sensors may be equally employed to determine the velocities of the boom, stick and bucket.

The logic means 250 additionally determines the work implement geometry and forces in response to the position and pressure signal information.

For example, the logic means 250 receives the pressure signals and computes boom, stick, and bucket cylinder forces, according to the following formula:

$$\text{cylinder force}=(P_2*A_2)-(P_1*A_1)$$

where $P_2$ and $P_1$ are respective hydraulic pressures at the head and rod ends of a particular cylinder 140,145,150, and $A_2$ and $A_1$ are cross-sectional areas at the respective ends.

The logic means 250 produces boom, stick and bucket cylinder command signals for delivery to an actuating means 265 which controllably moves the work implement 100. The actuating means 265 includes hydraulic control valves 270, 275,280 that control the hydraulic flow to the respective boom, stick and bucket hydraulic cylinders 140,145,150. The actuating means 265 also includes a hydraulic control valve 285 that controls the hydraulic flow to the swing assembly 185.

Figure 3:
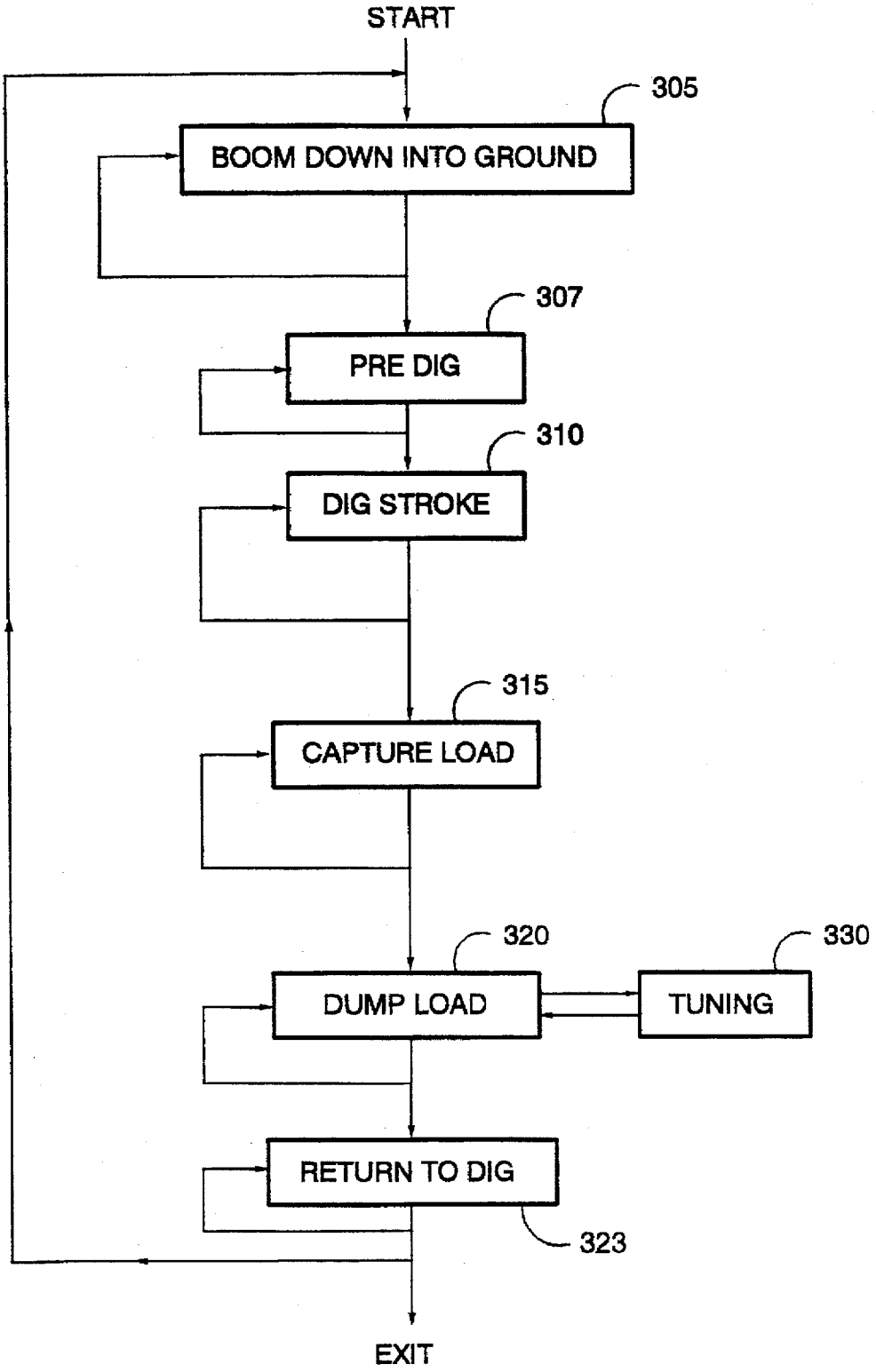
FIG. 3 is a top level flowchart representing the control of an excavation work cycle.

Referring now to FIG. 3, a flow diagram of an automated excavation work cycle is shown. The work cycle for an excavating machine 105 can generally be partitioned into six distinctive and sequential functions: boom-down-into-ground 305, pre-dig 307, dig-stroke 310, capture-load 315, dump-load 320, and return-to-dig 323. The dump-load function 320 advantageously includes a tuning function 330.

The present invention includes several embodiments of the tuning function 330. Therefore, only the tuning function 330 will be discussed in detail, as the detail of the other functions are not critical to the present invention. However, for greater discussion of the other functions, the reader is referred to U.S. Pat. No. 5,446,980 issued on Sep. 5, 1995 and entitled "Automatic Excavation Control System and Method", which was filed on the same date as the present application and is hereby incorporated by reference.

Figure 4:
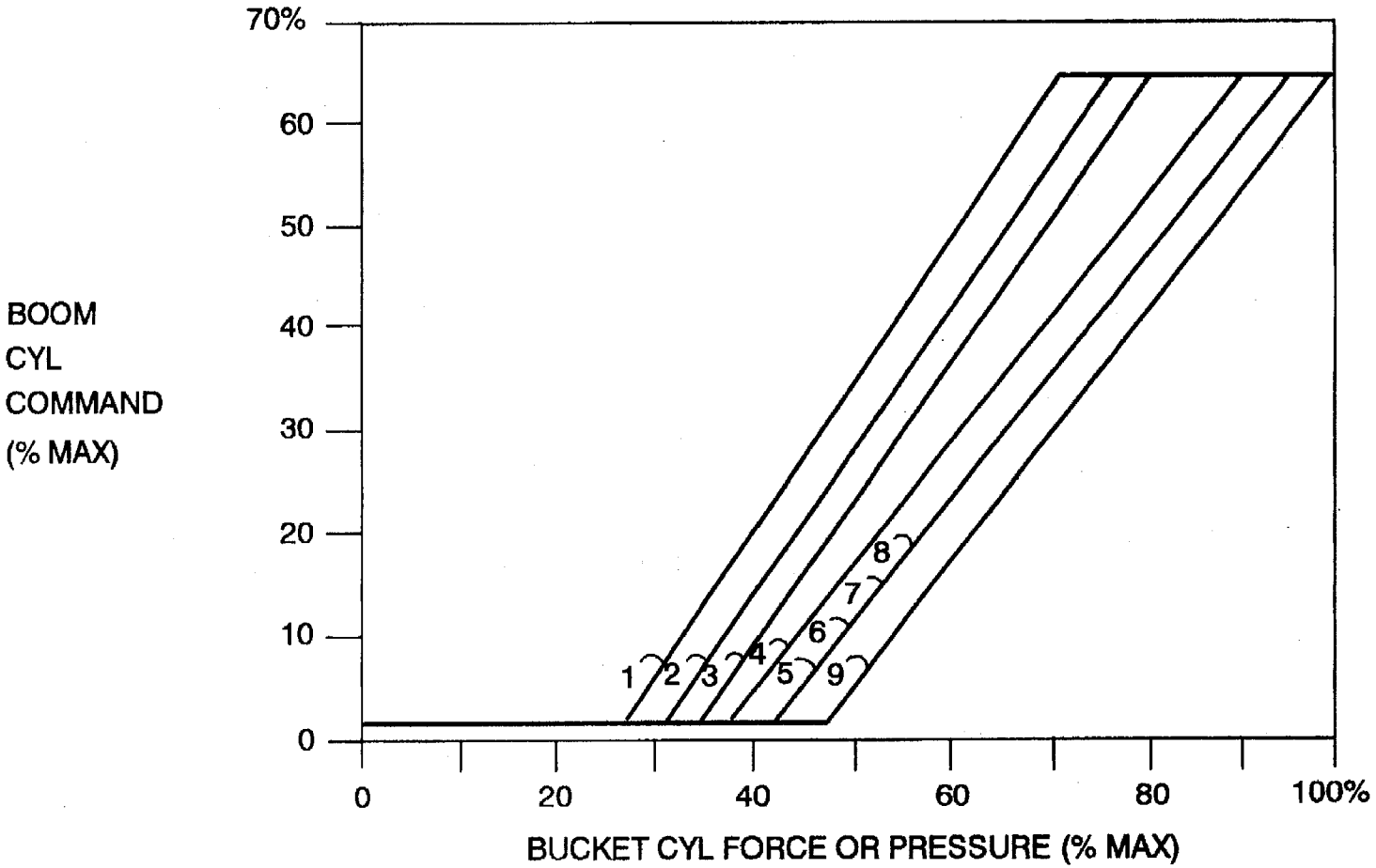
FIG. 4 is a table representing control curves pertaining to a boom cylinder command for a predig portion of the work cycle.
Figure 6:
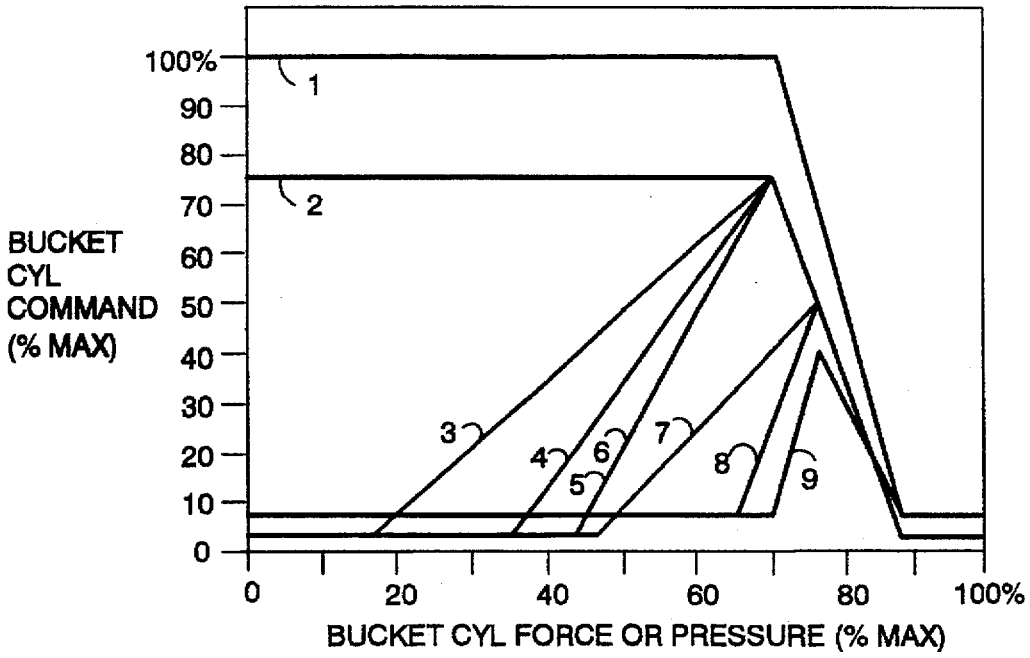
FIG. 6 is a table representing control curves pertaining to a bucket cylinder command for the digging portion of the work cycle.
Figure 5:
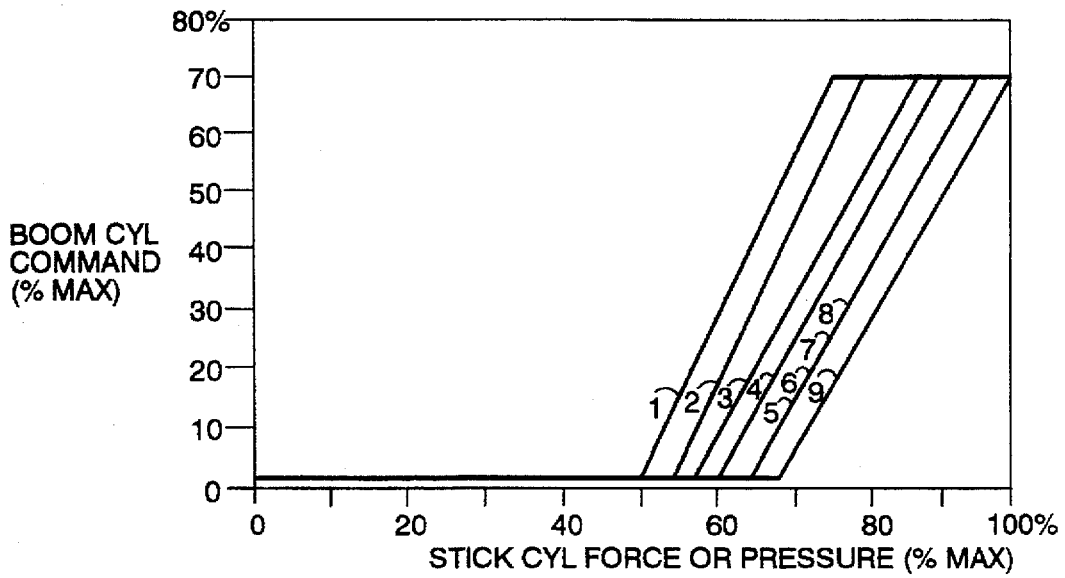
FIG. 5 is a table representing control curves pertaining to a boom cylinder command for a digging portion of the work cycle.

The tuning function 330 selects a material condition setting determinative of the appropriate ones of a plurality of control curves that command the displacement of the boom, stick, and bucket cylinders 140,145,150 at desired velocities. An example set of control curves are shown in the tables of FIGS. 4–6. Each control curve is representative of a command signal magnitude that controls the displacement of the boom, stick, and bucket cylinders 140,145,150. The curves may be defined by two-dimensional look-up tables or a set of equations that are stored in the microprocessor memory. The controlling curve is responsive to a material condition setting that represents the condition of the ground soil. For example, at the extremes, material condition setting 1 represents a loose condition of the material, while material condition setting 9 represents a hard packed condition of the material. Thus, intermediate material conditions settings 2–8 represent a continuum of material conditions from a loose or soft material condition to a hard material condition. It will be understood by those skilled in the art that the number of the control curves are responsive to the desired characteristics of the control.

Although the control curves may be automatically selected by the logic means 250, the operator interface 260 is provided to allow the operator to select a material condition setting corresponding to one or all the sets of the control curves. This gives the overall control greater flexibility.

The tables are now described:

FIG. 4 represents a table that stores the control curves associated with the boom cylinder 140 for pre-dig portion of the excavating work cycle. The magnitude of the command signal is responsive to the pressure or force imposed on the bucket cylinder 150.

FIG. 5 represents a table that stores the control curves associated with the boom cylinder 140 for the digging portion of the excavating work cycle. The magnitude of the command signal is responsive to the pressure or force imposed on the stick cylinder 145.

FIG. 6 represents a table that stores the control curves associated with the bucket cylinder 150 for the digging portion of the excavating work cycle. The magnitude of the command signal is responsive to the pressure or force imposed on the bucket cylinder 150. With each table, the controlling curve is responsive to the material condition setting. Thus, the material condition setting is important for efficient excavation performance.

Figure 7:
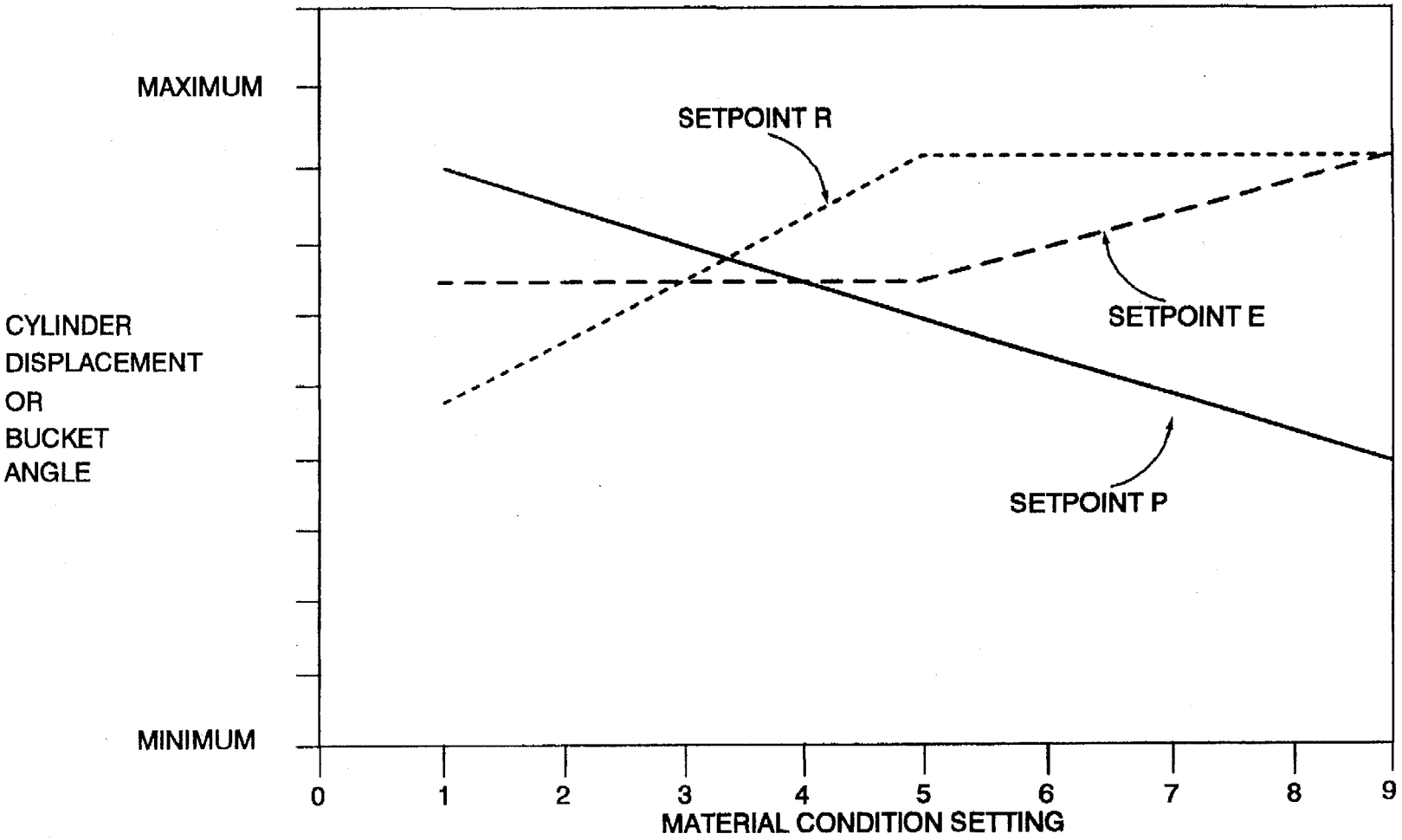
FIG. 7 is a table representing various setpoint values associated with various portions of the work cycle.

The present invention selects the appropriate control curve in response to estimating the actual condition of the material. The forgoing technique is not only valuable in determining the appropriate control curve but also may be valuable for determining one of a plurality of excavation set points. For example, the excavator control may compare cylinder displacements and pressures to a plurality of set points during the excavation work cycle. FIG. 7 shows a table that stores a plurality of setpoints for stick and bucket cylinder displacements, where each setpoint is responsive to a material condition setting.

The tuning function 330 uses several force calculations on the bucket 120 to estimate the material condition. These force calculations will now be described. Reference is made to the diagrammatic views of the work implement in FIGS. 1A and 1B. First, the logic means 250 determines the work implement geometry relative to the reference axis, R, in response to position information. The relative location of predetermined ones of the pins, points and center of gravities are calculated using well known geometric and trigonometric laws. For example, the work implement geometry may be determined by using the inverse trig functions, the law of sines and cosines, and their inverses. Further, the various forces on predetermined ones of the pins may be determined in response to position and pressure information. For example, the location and magnitude of the forces on the pins may be determined by using two-dimensional vector cross and dot products. It should be noted that the work implement geometry and force information may be determined by several methods well understood by those skilled in the art. For example, the various forces on the pins may be directly measured by using strain gauges or other structural load measurement methods.

Note, for the following description, the term "angle R.X.Y" represents the angle in radians between a line parallel to the reference axis, R, and the line defined by pins X and Y. The term "length X.Y" represents the length between points X and Y.

First, the sum of the forces on the boom-stick-bucket in the x-direction is determined in the following manner:

$\epsilon$ $F_x$ boom-stick-bucket=

$$F_x \text{ BUCKET}+F_x \text{ pin } 1+F_x \text{ pin } 2=0 \quad (1)$$

where, $F_x$ BUCKET is the external force applied to the bucket in the x-direction;

$F_x$ pin 1 represents the force applied to pin 1 in the x-direction, which may be determined by summing the forces on the boom at pin 1; and $F_x$ pin 2 represents the force applied to pin 2 in the x-direction, which is due to the axial force in the boom cylinder.

Rearranging equation (1) and solving for the force component, $F_x$ BUCKET, equation (1) is simplified as:

$F_x$ BUCKET=–$F_x$ pin 1–(axial force in the boom cylinder) *cos (angle R.11.2)

Second, the sum of the forces on the boom-stick-bucket in the y-direction may be calculated in a similar manner.

$\epsilon$ $F_y$ boom-stick-bucket=

$$F_y \text{ BUCKET}+F_y \text{ pin } 1+F_y \text{ pin } 2-\text{the weights of linkage components}=0 \quad (2)$$

where, $F_y$ BUCKET is the external force applied to the bucket in the y-direction;

$F_y$ pin 1 represents the force applied to pin 1 in the y-direction, which may be determined by summing the forces on the boom at pin 1; and $F_y$ pin 2 represents the force applied to pin 2 in the y-direction, which is due to the axial force in the boom cylinder.

Rearranging equation (2) and solving for the force component, $F_y$ BUCKET, equation (2) is shown as:

$F_y$ BUCKET=$-F_y$ pin 1−(axial force in the boom cylinder)*sin(angle R.11.2)+$\epsilon$ boom-stick-bucket weight+(the stick and bucket cylinder and rod weights) +(boom cylinder and rod weight at pin 2)

The external force applied to the bucket, $F_{xy}$ is calculated according to:

$F_{xy}=\sqrt{[(F_y \text{ BUCKET})^2+(F_x \text{ BUCKET})^2]}$

Finally, the moment arm of the external force on the bucket, MABUCKET, is calculated about pin 8 by summing the moments about pin 8. First, the force on the bucket normal to line 8.15, $F_N$ BUCKET, is calculated according to the following relationship:

$$F_N \text{BUCKET} = F_{XY} * [(\cos(\alpha) * \cos(\text{angle } R.15.16 + \Pi/2)) + (\sin(\alpha) * \sin(\text{angle } R.15.16 + \Pi/2)]$$

where, $$\alpha = \arctan(F_Y \text{ BUCKET}/F_X \text{ BUCKET})$$

To properly identify the quadrant where $\alpha$ resides, adjustment may made to $\alpha$ based on positiveness or negativeness of $F_x$ BUCKET and $F_y$ BUCKET. For example, if $F_x$ BUCKET and $F_y$ BUCKET have both negative values, then H radians are subtracted from $\alpha$. Moreover if $F_x$ BUCKET has a negative value, while $F_y$ BUCKET has a positive value, then H radians are added to $\alpha$.

Second, the moment about pin 8, $M_8$, is calculated according to:

$$M_8 = \text{length of } 8.10 * \text{force on } 9.10 * [\cos(\text{angle } R.8.10) * \sin(\text{angle } R.9.10) - \cos(\text{angle } R.9.10) * \sin(\text{angle } R.8.10)] + \text{length of } 8.14 * \text{bucket weight} * [\cos(\text{angle } R.8.14) * \sin(-\Pi/2) - \cos(-\Pi/2) * \sin(\text{angle } R.8.14)]$$

Finally, the moment arm of the external force on the bucket, MA BUCKET, is calculated according to:

MA BUCKET=$M_8/F_N$ BUCKET

The tuning function 330 is now described. The tuning function 330 "tunes" the excavating performance by determining the appropriate ones of the plurality of control curves used in FIGS. 4–6 or the appropriate one of the plurality of material condition settings of FIG. 7. The tuning function 330 determines the appropriate material condition setting based on current operating conditions of the excavation work cycle. FIGS. 8, 10, 12, and 14 are flowcharts illustrating a program control for implementing the preferred embodiment of the present invention.

One method of performing the tuning function 330 is described with reference to the flowchart of FIG. 8. First, the payload carried in the bucket 120 is determined at block 805. The payload may be determined by well known methods. For example, based on the work implement geometry and cylinder forces the payload may be determined. One such payload determination is shown by Applicant's co-pending application entitled "Payload Determining System For An Excavating Machine" (Atty. Docket No. 93-327), which was filed on the same date as the present application and is hereby incorporated by reference. Next, at block 810, the work performed by the stick and bucket cylinders 145,150 during the prior dig pass is calculated. Preferably, the work calculations are made just after each dig pass. The work may be calculated according to the following formula:

$$\text{work}=(\text{cylinder force}*\text{cylinder displacement})$$

The calculated payload value is then divided by the work value at block 815. Finally, the result of block 815 is then compared to values of a two-dimensional look-up table to determine the appropriate material condition setting at block 820.

Figures 8, 9:
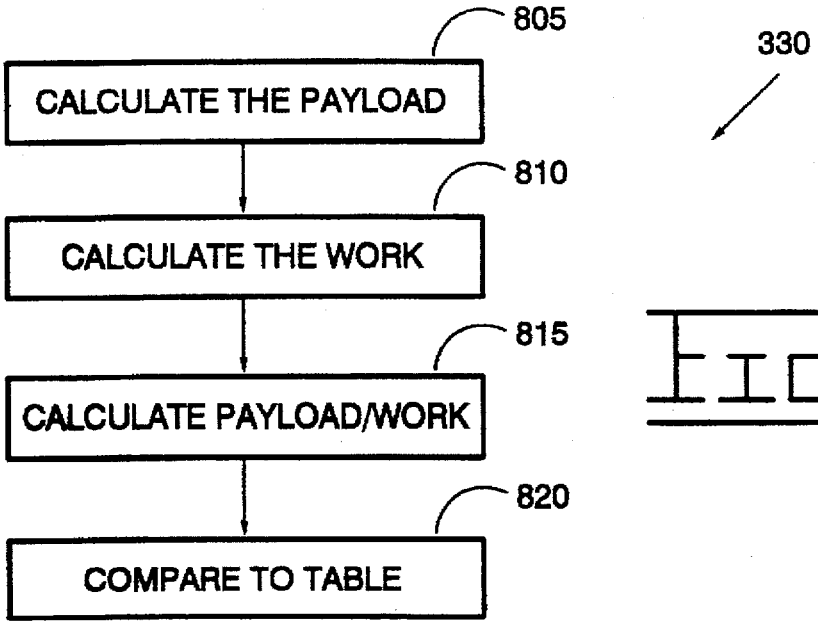
FIG. 8 is a second level flowchart of an embodiment of a tuning function.
FIG. 9 is a table representing a plurality of payload/work values corresponding to a plurality of predetermined material condition settings associated with the embodiment of FIG. 8.

For example, reference is now make to FIG. 9, which represents a table of a plurality of predetermined payload/work values that correspond to a plurality of predetermined material conditions. Here, the control matches the calculated payload/work value with the values of the look-up table. If the current material condition setting deviates from that shown by the look-up table for the calculated payload/work value, then the current material condition setting is set to that shown by the look-up table. Otherwise, the material condition setting is unchanged.

This method shows that the harder the material, the greater amount of work is required to excavate the material for a predetermined amount of payload, than for a softer material. Thus, based on the payload to work ratio, the appropriate material condition setting may be determined.

Figure 10:
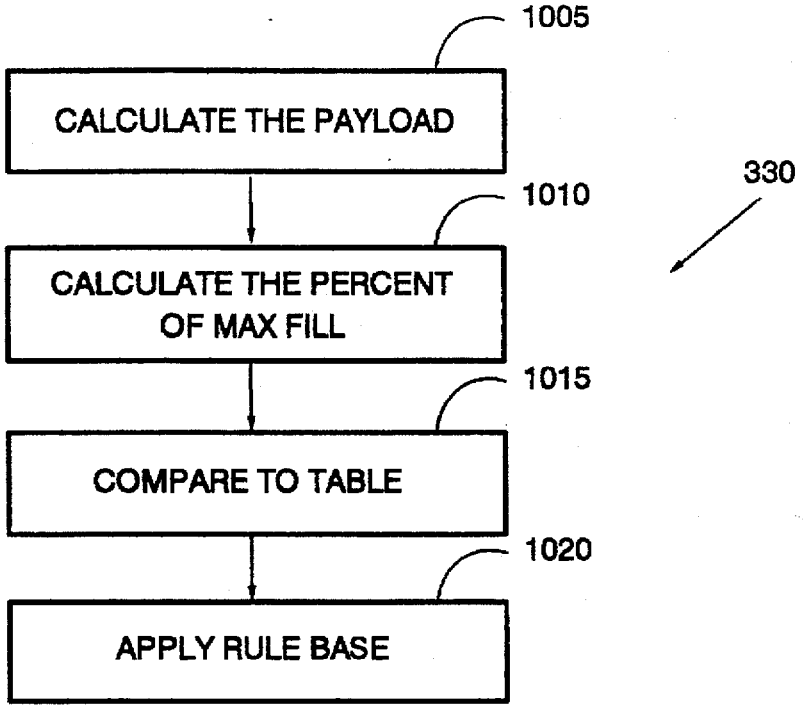
FIG. 10 is a second level flowchart of another embodiment of the tuning function.

Another method of performing the tuning function 330 is described with reference to the flowchart of FIG. 10. First, the payload carried in the bucket 120 is calculated at block 1005. Then, in response to the payload calculation, the percent of maximum fill of the bucket 120 is determined at block 1010. For example, based on the bucket capacity, the payload calculation can give an estimation of the percent of maximum fill of a typical earthen material that is captured in the bucket 120. At block 1015, the above result is compared to values of a two-dimensional look-up table to determine if material condition setting is set to the appropriate value.

Figure 11:
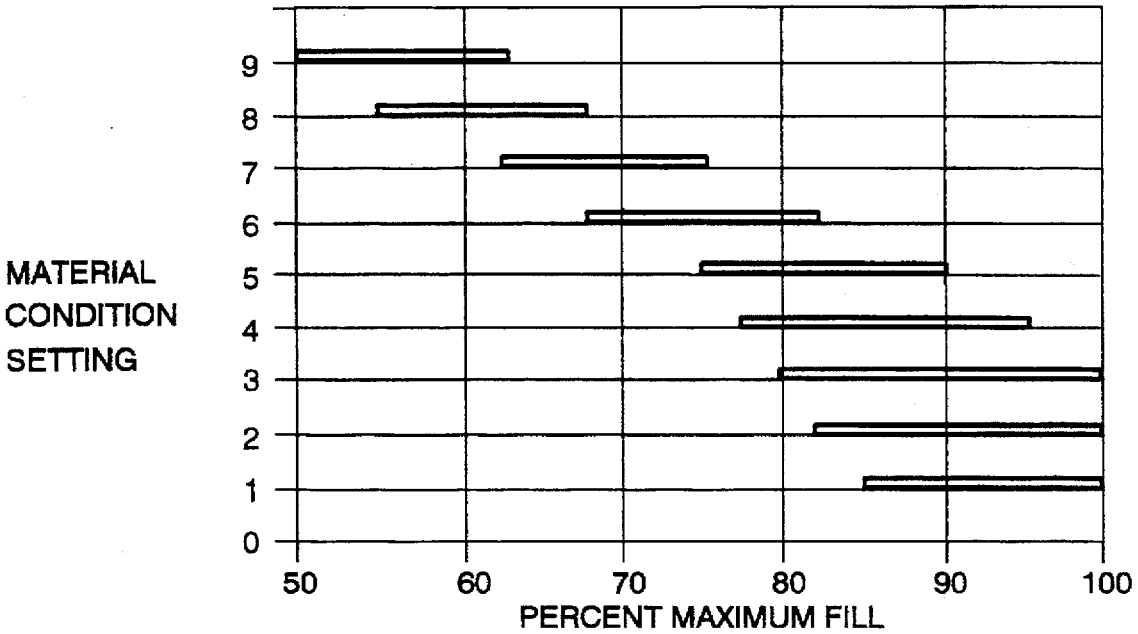
FIG. 11 is a table representing a plurality of predetermined bucket fill values corresponding to a plurality of predetermined material condition settings associated with the embodiment of FIG. 10.

For example, reference is now make to FIG. 11, which represents a table of a plurality of predetermined percent of maximum fill values that correspond to a plurality of predetermined material conditions. Here, the control compares the calculated percent of fill value with the predetermined percent of fill values to determine if the material condition setting is set to the appropriate value. The table shows that a softer material will fill the bucket with a greater amount of material than a harder material. Thus, based on the calculated percent of maximum fill, the material condition setting may be evaluated.

If the calculated percent of maximum fill falls within the range established by the table for the current material condition setting, then the material condition setting is said to be set to the appropriate value. However, if the calculated percent of maximum fill falls outside the range established by the table for the current material condition setting, then the material condition setting should be modified. For example, if the calculated percent of maximum fill is 80% and the current material condition setting is "5", then the material condition setting is appropriate. However, if the current material condition setting is "9" rather than "5", then the material condition setting should be modified.

As indicated by block 1020, a set of rules may be used to determine the appropriate material condition setting. An example set of rules is shown below:

CURRENT MATERIAL CONDITION SETTING=1

1. If bucket fill is greater than 85% of max fill, then o.k.
2. If bucket fill is between 70% and 85%, then change material condition setting to 3.
3. If bucket fill is between 50% and 70%, then change material condition setting to 5.
4. If bucket fill is less than 50%, then change material condition setting to 7.

CURRENT MATERIAL CONDITION SETTING=5

1. If bucket fill is greater than 90% of max fill, then change material condition setting to 3.
2. If bucket fill is between 75% and 90%, then o.k.
3. If bucket fill is between 50% and 75%, then change material condition setting to 7.
4. If bucket fill is less than 50%, then change material condition setting to 9.

CURRENT MATERIAL CONDITION SETTING=9

1. If bucket fill is greater than 75%, then change material condition setting to 5.
2. If bucket fill is between 62% and 75%, then change material condition setting to 7.
3. If bucket fill is less than 62%, then o.k.

The above set of rules are for exemplary purposes only and does not limit the present invention. It will be apparent to those skilled in the art that a predetermined set of rules may be used to determine the appropriate value for all material condition settings.

Figure 12:
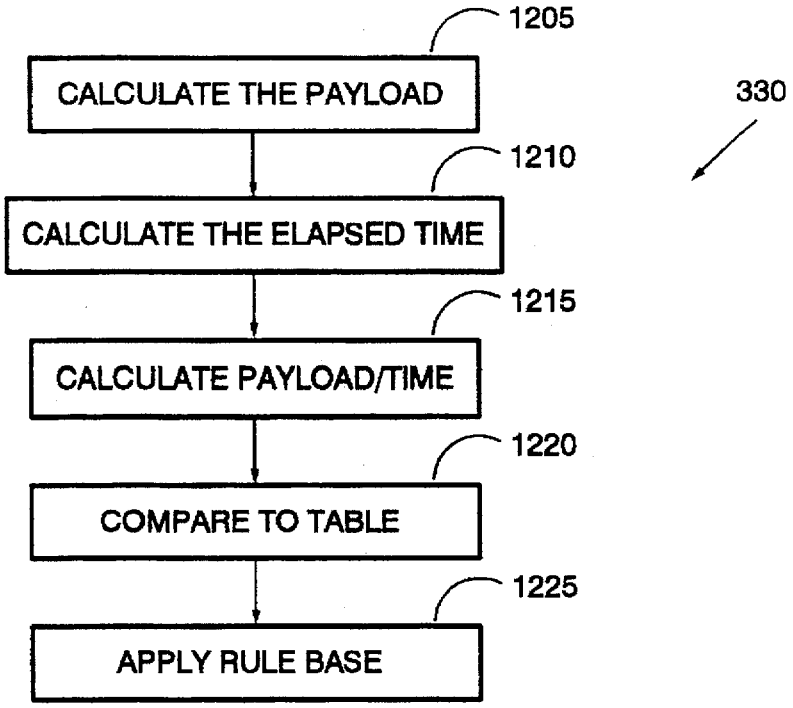
FIG. 12 is a second level flowchart of yet another embodiment of the tuning function.

Yet another method of performing the tuning function 330 is described with reference to the flowchart of FIG. 12. First, the payload carried in the bucket 120 is determined at block 1205. Next, at block 1210, the time elapsed during the prior dig pass is calculated. The time elapsed represents the time from start to finish of a single dig-stroke operation. The calculated payload value is then divided by the elapsed time, at block 1215, to determine the efficiency or productivity of the work cycle. Then, at block 1220, the productivity value is compared to values of a two-dimensional look-up table to determine if the material condition setting is set to the appropriate value.

Figure 13:
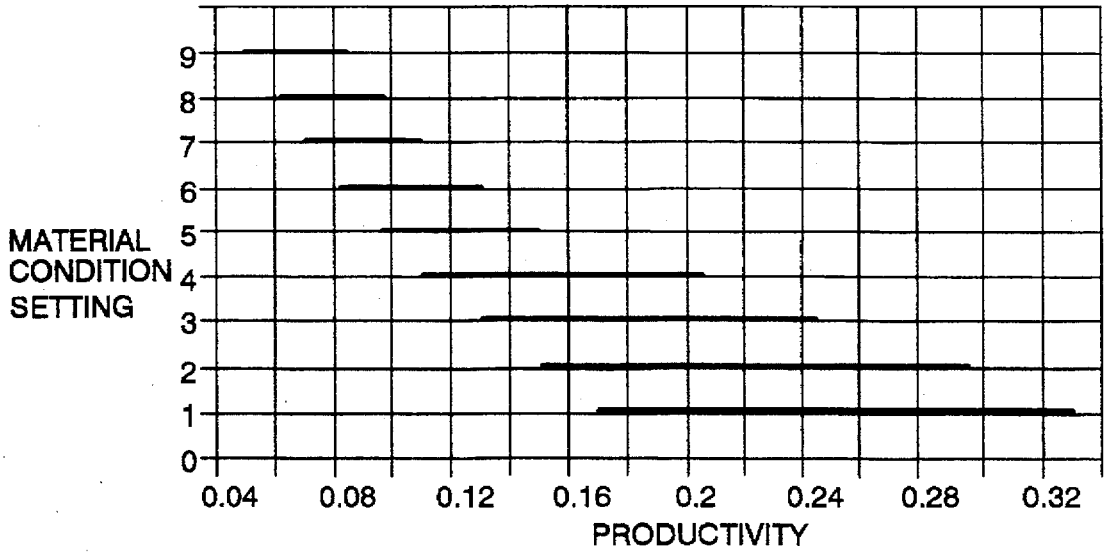
FIG. 13 is a table representing a plurality of productivity values corresponding to a plurality of predetermined material condition settings associated with the embodiment of FIG. 12.

For example, reference is now made to FIG. 13, which represents a table of a plurality of predetermined productivity values that corresponds to a plurality of predetermined material conditions. Here, the control compares the calculated productivity value with the predetermined productivity values for the current material condition setting to determine if the material condition setting is set to the appropriate value. The table shows that the softer the material, the greater amount of productivity is yielded. Thus, based on the calculated productivity, the material condition may be evaluated.

If the calculated productivity value is within the range established by the table of predetermined productivity values for the current material condition setting, then the material condition setting is said to be set to the proper value. However, if the calculated productivity value falls outside the range established by the table, then the material condition setting should be modified. As shown by block 1225, the material condition setting may be modified by a set of rules similar to that described above. It is noted that determining a set of rules to modify the material condition setting will readily be apparent to those skilled in the art, based on the instant disclosure.

Figure 14:
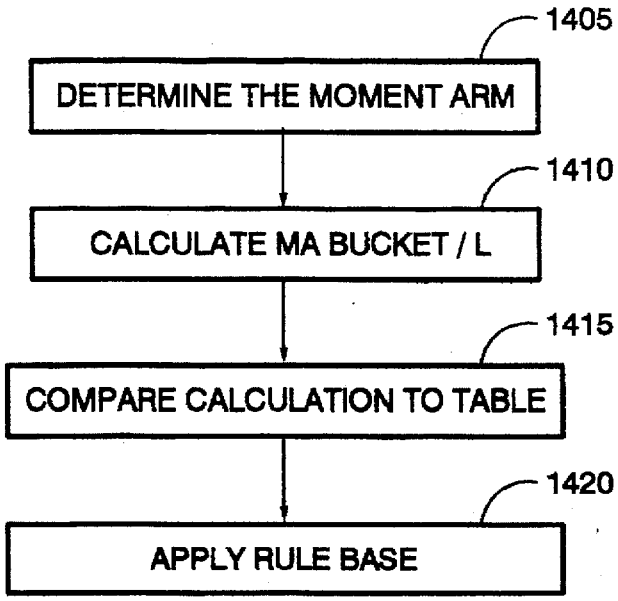
FIG. 14 is a second level flowchart of another embodiment of the tuning function.
Figure 16A:
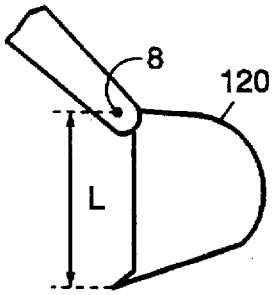
FIGS. 16A, 16B, 16C are diagrammatic views of a work implement illustrating the embodiment of FIG. 14.

The final method of performing the tuning function 330 is described with reference to the flowchart of FIG. 14. First, the moment arm, MA BUCKET, is determined at block 1405 in accordance with the above calculations. Next, at block 1410, the value of MA BUCKET is divided by a predetermined value, L. The predetermined value, L, represents a moment arm extending the entire distance from pin 8 to the bucket tip, shown by FIG. 16A. At block 1415, the divisional result is compared to values of a two-dimensional look-up table to determine if the material condition setting is set to the appropriate value.

Figure 15:
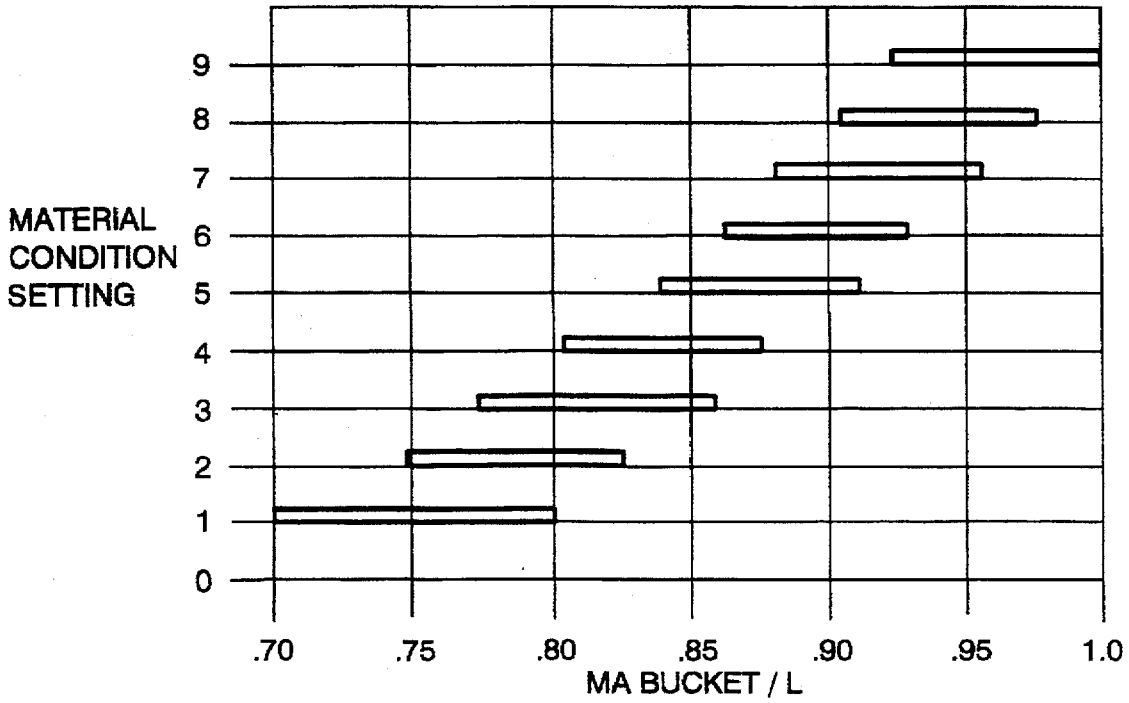
FIG. 15 is a table representing a plurality of moment arm values corresponding to a plurality of predetermined material condition settings associated with the embodiment of FIG. 14.

For example, reference is now made to FIG. 15, which represents a table of a plurality of predetermined values that corresponds to a plurality of predetermined material conditions. Here, the control compares the divisional result of block 1415 with the values of the look-up table to determine if the material condition setting is set to the proper value. The table shows that for a harder material the external force on the bucket will be located closer to the bucket tip, than for a softer material. Thus, based on the location of the external force vector, the material condition may be evaluated.

If the calculated value is within the range established by the table for the current material condition setting, then the material condition setting is said to be set to the appropriate value. However, if the calculated value falls outside the range established by the table, then the material condition setting should be modified. As shown by block 1420, the material condition setting may be modified by a set of rules similar to that described above.

Figure 16B:
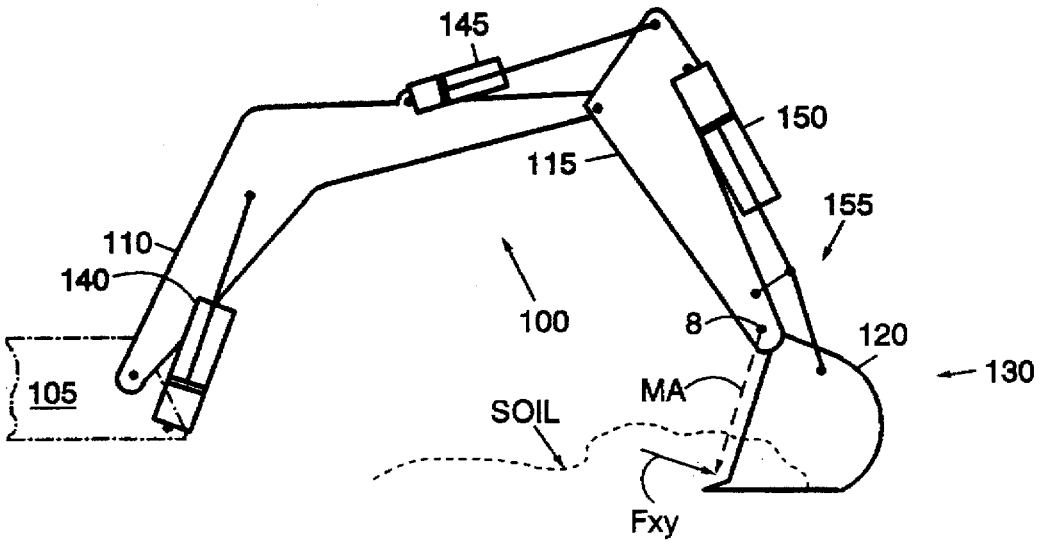
Figure 16C:
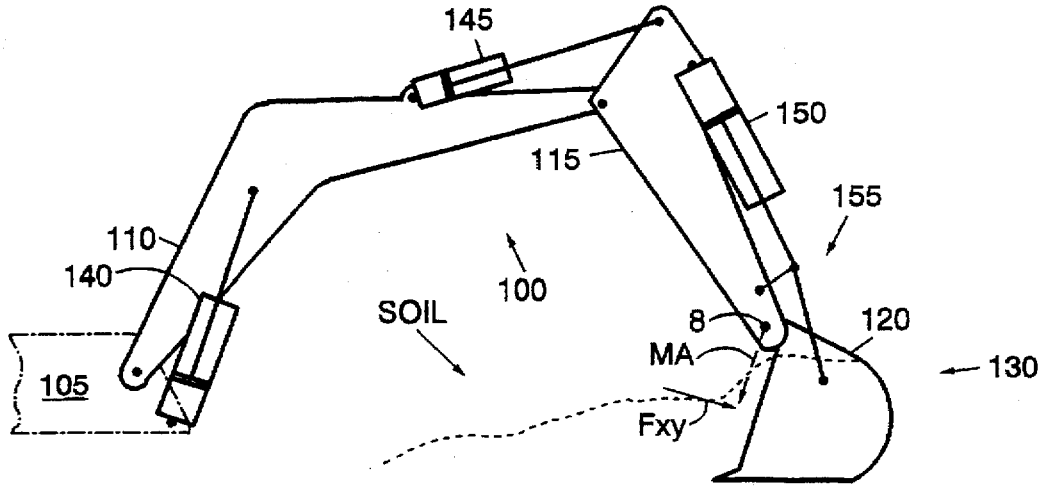

FIGS. 16B,C show examples of the location of the external force while the machine is excavating. FIG. 16B shows that the external force is located near the tip of the bucket 120, which represents a harder material. As shown in FIG. 16C, the external force is a distance away from the bucket tip, which indicates that the material is soft and is somewhat easy to excavate.

The methods described above may be used as discrete independent methods or used in combination to supplement each other. Moreover, it may be desirable to supplement the above methods with operator selectability. For example, the material condition setting of the control curves pertaining to the dig-stroke function, tables 5 and 6, may be manually set by the operator, while the remainder of the material condition settings associated with the other tables may be automatically set by the logic means 250. This allows for an experienced operator to have greater control of the work cycle.

The values shown in the tables may be determined with routine experimentation by those skilled in the art of vehicle dynamics, and familiar with the excavation process. The values shown herein are for exemplary purposes only.

Industrial Applicability

Figure 17:
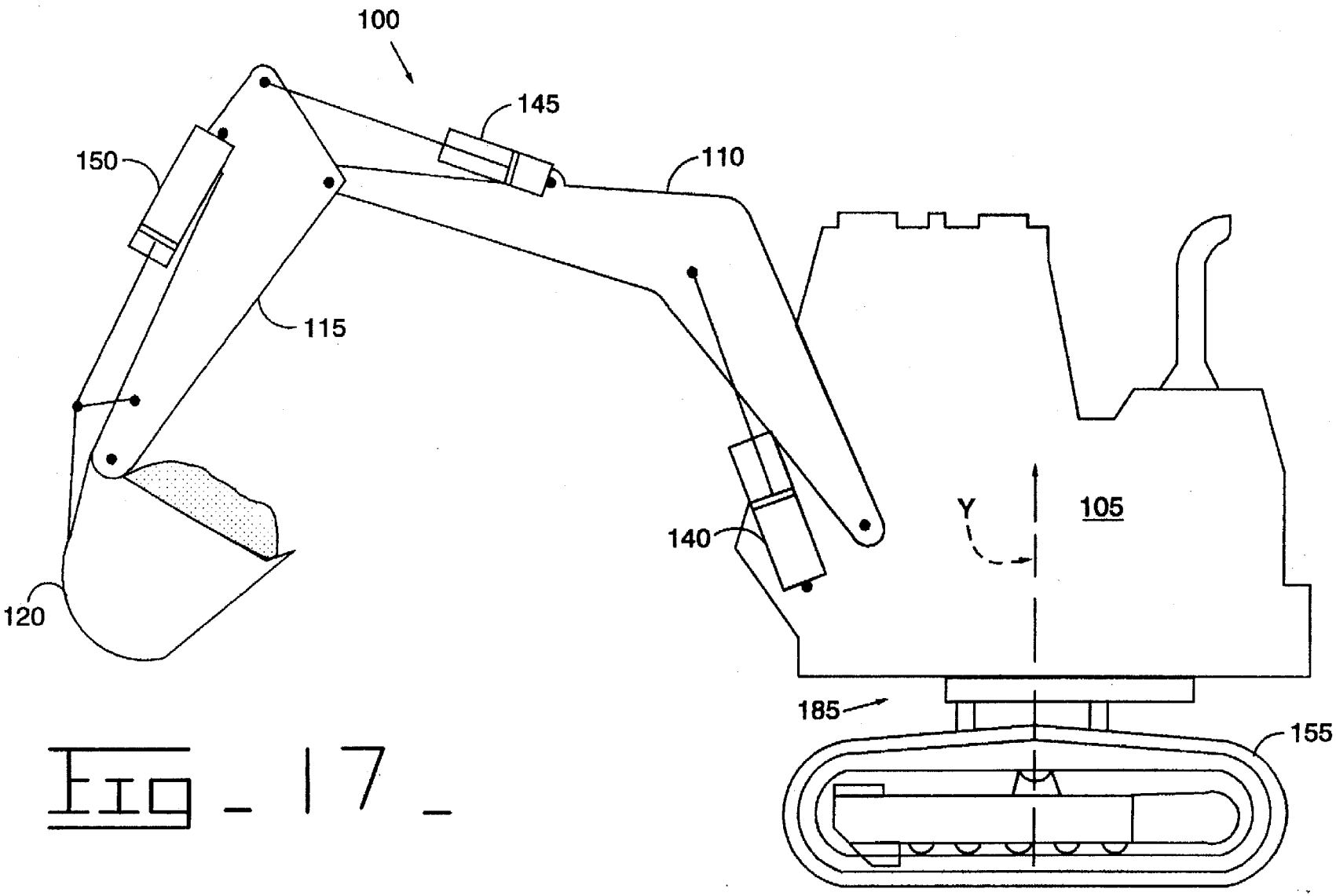
FIG. 17 is a side view of the excavating machine.

The operation of the present invention is best described in relation to its use in relation to its use in earthmoving vehicles, particularly those vehicles which perform digging or loading functions such as excavators, backhoe loaders, and front shovels. For example, a hydraulic excavator is shown in FIG. 17, where line Y is a vertical line of reference.

In an embodiment of the present invention, the excavating machine operator has at his disposal two work implement control levers and a control panel or operator interface 260. Preferably, one lever controls the boom 110 and bucket 115 movement, and the other lever controls the stick 115 and swing movement. The operator interface 260 provides for operator selection of operator options and entry of function specifications.

Figure 18:
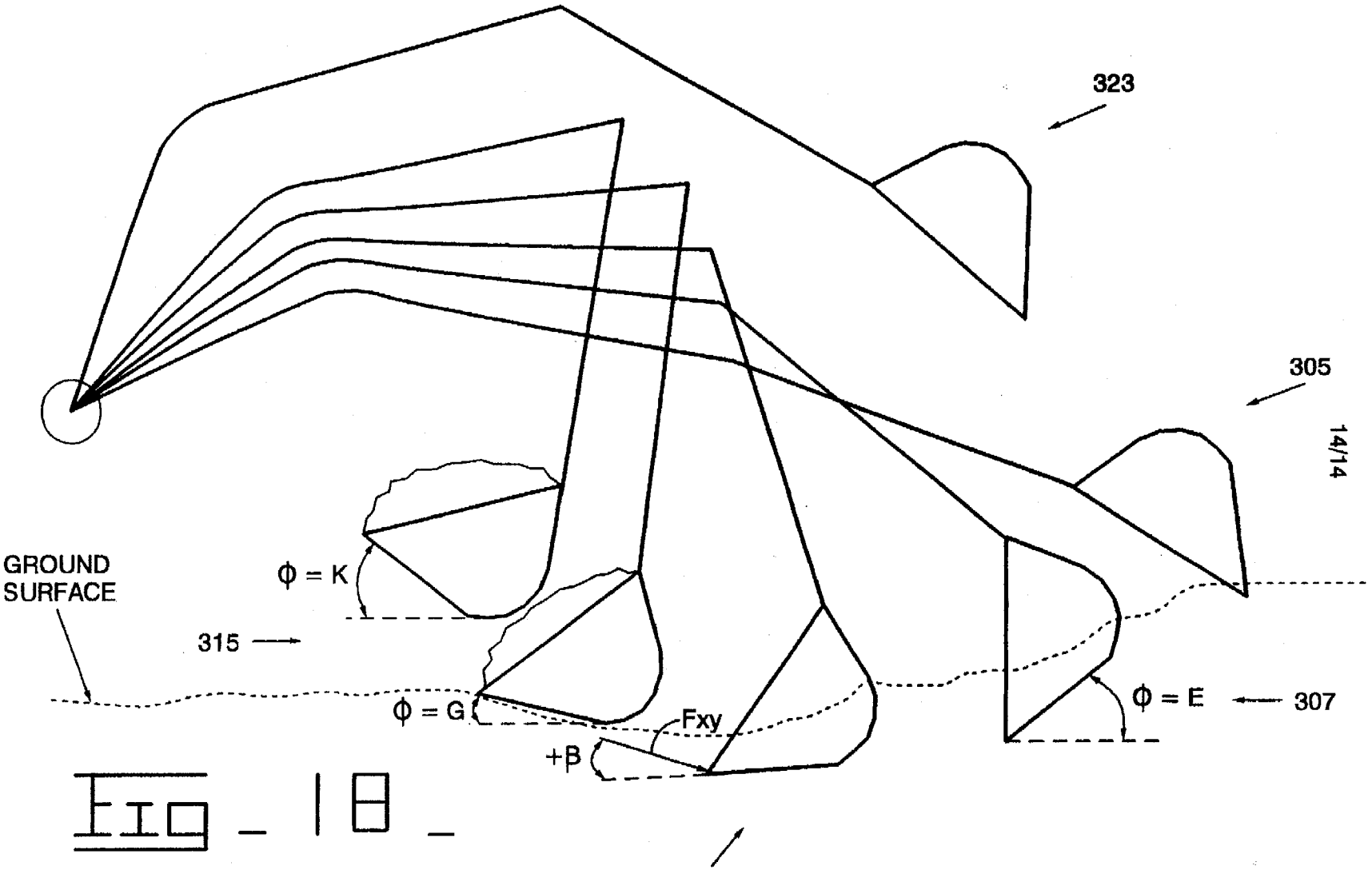
FIG. 18 is a diagrammatic view of the work implement during various stages of the excavation work cycle.

For an autonomous excavation operation, the operator is prompted for a desired dig depth, dig location, and dump location. Reference is now made to FIG. 18, which illustrates an excavation work cycle. For this illustration, assume that the bucket 120 has entered the ground. First, the logic means 250 initiates the pre-dig portion of the work cycle 307 by commanding the bucket 120 to curl at nearly full velocity until a predetermined cutting angle is reached. As the bucket curls, the boom 110 is raised at a velocity dictated by one of the control curves shown in FIG. 4. Simultaneously, the stick 115 is commanded inward at a predetermined velocity. The control curves dictate a command signal magnitude that produces a predetermined amount of force in the bucket and stick cylinders 150,145 to produce a desired amount of penetration into the ground.

Once the bucket 120 has curled to the predetermined cutting angle, the logic means 250 initiates the dig-stroke portion of the work cycle 310 by commanding the boom 110 to raise according to one of the control curves of FIG. 5, while the bucket 120 is commanded to curl according to one of the control curves of FIG. 6. The stick 115, however, is commanded at nearly full velocity to retrieve as much material from the ground as possible. The control curves of FIGS. 5 and 6 dictate command signal magnitudes that keep the stick and bucket cylinder pressures at desirable levels.

Once the digging is complete, the logic means 250 initiates the capture-load portion of the work cycle 315 by commanding the stick velocity to reduce to zero, the boom 110 to raise, and the bucket 120 to curl.

Once the load is captured, the logic means 250 initiates the dump-load portion of the work cycle 320 by commanding the work implement 100 to rotate toward the dump location, the boom 110 to raise, the stick 115 to reach, and the bucket 120 to uncurl, until the desired dump location is reached. Additionally, the logic means 250 initiates the tuning portion of the work cycle 330 by estimating the condition of the material and selecting a new material condition setting, if necessary.

After the load is dumped, the logic means 250 initiates the return to dig portion of the work cycle 323 by commanding the work implement 100 to rotate toward the dig location, the boom 110 to lower, and the stick 115 to reach a greater amount, until the dig location is reached. Finally, logic means initiates the boom-down portion of the work cycle 305 by commanding the boom 110 to lower toward the ground until the bucket 120 makes contact with the ground.

Other aspects, objects and advantages of the present invention can be obtained from a study of the drawings, the disclosure and the appended claims.

I claim:

1. A control system for automatically controlling a work implement of an excavating machine through a machine work cycle, the work implement including a boom, stick and bucket, each being controllably actuated by at least one respective hydraulic cylinder, the hydraulic cylinders containing pressurized hydraulic fluid, the control system comprising:

memory means for storing a plurality of command signal magnitudes for controlling at least one hydraulic cylinder, the command signal magnitudes being represented by a plurality of control curves, each control curve corresponding to a material condition setting that is representative of a condition of an excavated material;

logic means for selecting one of the plurality of control curves responsive to a determined said material condition setting indicated by the condition of the excavated material and producing command signals having a magnitude dictated by the selected said control curve; and actuating means for receiving the command signals and responsively actuating predetermined ones of the hydraulic cylinders to perform the work cycle.

2. A control system, as set forth in claim 1, wherein said logic means determines the condition of material excavated during a work cycle and automatically selects said one of the plurality of control curves, said logic means producing said command signals from said selected control curve during a subsequent work cycle in response to the determined material condition setting.

3. A control system, as set forth in claim 2, including an operator interface means for providing the operator an option of manually selecting one of the plurality of control curves.

4. A control system, as set forth in claim 1, wherein said logic means produces said command signals having magnitudes dictated by said selected control curve responsive to a force imposed on a said hydraulic cylinder.

5. A control system, as set forth in claim 4, further comprising hydraulic fluid pressure sensors for measuring said force imposed on said hydraulic cylinder.

6. A method for automatically controlling a work implement of an excavating machine through a machine work cycle, the work implement including a boom, stick and bucket, each being controllably actuated by at least one respective hydraulic cylinder, the hydraulic cylinders containing pressurized hydraulic fluid, the method comprising the steps of:

storing a plurality of command signal magnitudes associated with at least one hydraulic cylinder, the command signal magnitudes being represented by a plurality of control curves, each control curve corresponding to a material condition setting that is representative of a condition of an excavated material;

selecting one of the plurality of control curves responsive to a material condition setting determined from said excavated material condition and producing a command signal having a magnitude dictated by the selected control curve, responsive to a force imposed on a said hydraulic cylinder;

receiving the command signal and controllably actuating predetermined ones of the hydraulic cylinders in response to said command signal to perform the work cycle.

7. A method, as set forth in claim 6, further including the step of determining said material condition setting based on the condition of material excavated during a single work cycle and automatically selecting one of the plurality of control curves in response to the determined material condition setting.

8. A method, as set forth in claim 7, including the steps of:

calculating a bucket payload value;

calculating the work performed by stick and bucket cylinders during a digging portion of the work cycle; and deriving a bucket payload/work quotient value by dividing the bucket payload value by the work performed, the divisional result being indicative of a condition of the material.

9. A method, as set forth in claim 8, including the steps of:

storing a plurality of predetermined bucket payload/work quotient values corresponding to a plurality of predetermined material condition values;

comparing the calculated bucket payload/work quotient value to the stored bucket payload/work quotient values; and selecting one of the plurality of control curves in response to the comparison.

10. A method, as set forth in claim 7, including the steps of:

calculating a bucket payload value;

calculating the time elapsed during a single pass of the digging portion of the work cycle; and dividing the bucket payload value by the elapsed time to determine a productivity value for the digging pass, the productivity value being indicative of a condition of the material.

11. A method, as set forth in claim 10, including the steps of:

storing a plurality of predetermined productivity values corresponding to a plurality of predetermined material condition values;

comparing the calculated productivity value to the stored productivity values; and selecting one of the plurality of control curves in response to the comparison.

12. A control system, as set forth in claim 7, including the steps of:

calculating a bucket payload value; and estimating a bucket fill percentage, said bucket fill percentage being representative of the amount that the bucket is filled with excavated material, said bucket fill percentage being function of said bucket payload value and indicative of a condition of the material.

13. A method, as set forth in claim 12, including the steps of:

storing a plurality of predetermined bucket fill values corresponding to a plurality of predetermined material condition values;

comparing the estimated bucket fill value to the stored bucket fill values; and selecting one of the plurality of control curves in response to the comparison.

14. A method, as set forth in claim 7, including the steps of:

calculating a moment arm magnitude value, said moment arm magnitude value being representative of the external force acting on the bucket, said moment arm magnitude value being indicative of a condition of the material.

15. A method, as set forth in claim 14, including the steps of:

storing a plurality of predetermined moment arm magnitude values corresponding to a plurality of predetermined material condition values;

comparing the calculated moment arm magnitude value to the stored moment arm magnitude values; and selecting one of the plurality of control curves in response to the comparison.

16. A control system for automatically controlling a work implement through a machine work cycle, said implement having a bucket controllably actuated by at least one hydraulic cylinder, comprising:

memory means for storing a plurality of command signal magnitudes for controlling said at least one hydraulic cylinder, said command signal magnitudes being described in correspondence with respective hydraulic cylinder pressures by a plurality of control curves, each control curve corresponding to a material condition setting that is representative of a condition of an excavated material;

logic means for selecting one of the plurality of control curves responsive to a determined said material condition setting indicated by the condition of the excavated material and responsively producing command signals having a magnitude dictated by the selected said control curve; and actuating means for receiving the command signals and responsively actuating predetermined ones of the hydraulic cylinders to perform the work cycle.

17. A control system, as set forth in claim 16, further comprising said logic means determining said material condition setting based on the condition of material excavated during a digging portion of a work cycle and automatically selecting one of the plurality of control curves to control a subsequent subsequent work cycle in response to the determined material condition setting.

18. A control system, as set forth in claim 17, further comprising said logic means:

calculating a bucket payload value; calculating a second value representing at least one of the elapsed time and the work required to excavate said material; and determining said material condition on the basis of a ratio between said payload and said second values.

19. A control system, as set forth in claim 17, further comprising said logic means:

calculating a bucket payload value; and estimating a bucket fill percentage, said bucket fill percentage being representative of the amount that the bucket is filled with excavated material, said bucket fill percentage being function of said bucket payload value and indicative of a condition of the material.

* * * * *